US006426690B1

(12) United States Patent
Takenoshita et al.

(10) Patent No.: US 6,426,690 B1
(45) Date of Patent: Jul. 30, 2002

(54) ELECTROMAGNETIC COIL DEVICE

(75) Inventors: Kouichi Takenoshita; Toshihiro Yoneda, both of Miyazaki (JP)

(73) Assignee: Honda Lock Mfg. Co., Ltd., Miyazaki (JP)

( * ) Notice: Subject to any disclaimer, the term of this patent is extended or adjusted under 35 U.S.C. 154(b) by 0 days.

(21) Appl. No.: 09/661,911

(22) Filed: Sep. 14, 2000

(30) Foreign Application Priority Data

Sep. 17, 1999 (JP) ..... 11-262947
Sep. 17, 1999 (JP) ..... 11-262948

(51) Int. Cl.[7] ..... H01F 7/08
(52) U.S. Cl. ..... 335/220; 335/225
(58) Field of Search ..... 335/220–229; 310/272–4

(56) References Cited

U.S. PATENT DOCUMENTS 4,448,275 A * 5/1984 Kitagawa et al. ..... 180/142
5,307,038 A * 4/1994 Ishimaru ..... 335/296

* cited by examiner

*Primary Examiner*—Lincoln Donovan
*Assistant Examiner*—Tuyen T. Nguyen
(74) *Attorney, Agent, or Firm*—Liniak, Berenato, Longacre & White

(57) ABSTRACT

An electromagnetic coil device, for example, used in a torque detector comprising a coil assembly including a bobbin and coils, a housing for covering the coil assembly, an electric circuit contained in the housing, and a plurality of bus-bars, each one end arranged in the coupler of the housing and the other end connected to the electric circuit for insertion molded to the housing, in which a bus-bar assembly comprises the plurality of bus-bars having caulking portions which can be caulked with the bobbin and a cover which partly covers the bus-bars and abutting against the outer periphery of the coil assembly, and the housing covers the coil assembly and the bus-bar assembly temporarily secured to the coil assembly by abutting the cover against the coil assembly and by caulking the caulking portions with the bobbin, connection terminals as a part of the bus-bars being bent by pressing against bending pedestals formed to the housing.

4 Claims, 12 Drawing Sheets

ELECTROMAGNETIC COIL DEVICE

BACKGROUND OF THE INVENTION

1. Field of the Invention

The present invention concerns an electromagnetic coil device used, for example, in a torque detector. More specifically the present invention relates to an electromagnetic coil device, which comprises a coil assembly including a bobbin made of a synthetic resin and coils wound around the bobbin, a housing made of a synthetic resin and integrally having a coupler for covering the coil assembly, an electric circuit contained in the housing, and a plurality of bus-bars each having one end arranged in the coupler and the other end connected to the electric circuit for insertion molded to the housing.

1. Description of the Prior Art

Most of existent electromagnetic coil devices of the above-mentioned type have electric circuits located outside the housings and, accordingly, are not compact in the constitution. Therefore, it may be considered to contain the electric circuits in the housing of the device. For this purpose, however, a plurality of bus-bars which connect a coupler formed on the housing with the electric circuits have to be insertion molded at accurate locations during molding process for the housing, which may possibly cause misalignment.

Further, when connection terminals as a portion of the bus-bars are connected to the board of the electric circuit, for example, by soldering, the connection terminals may possibly be detached from the circuit board because of thermal expansion and shrinkage of the terminals during heat treatment. In a customary countermeasure, the connection terminals are previously bent to absorb expansion and shrinkage in the bent portion. However, when the connection terminals are formed from the portion of bus-bars joined by insertion-molding to the housing, they must be bent after molding of the housing, because of structural restriction of the housing molding die, which complicates the bending operation for the connection of the terminals or requires a bending jig of a special structure.

SUMMARY AND OBJECT OF THE INVENTION

The present invention has been made in view of the situations described above and intends to provide an electromagnetic coil device in which a plurality of bus-bars can be insertion molded to a housing while preventing misalignment during molding of the housing.

The present invention also intends to provide a structure for connecting terminals to a circuit board, for example, in an electromagnetic coil device which can easily bend connection terminals by a simple jig.

The foregoing object can be attained in accordance with the first feature of the present invention by an electromagnetic coil device, comprising:

a coil assembly including a bobbin made of a synthetic resin and coils wound around the bobbin;

a housing made of a synthetic resin and integrally having a coupler for covering the coil assembly;

an electric circuit contained in the housing; and a plurality of bus-bars, each having one end arranged in the coupler and the other end connected to the electric circuit for insertion molded to the housing, in which a bus-bar assembly comprises the plurality of bus-bars including bus-bars having caulking portions which can be engaged by caulking with the bobbin and a cover made of a synthetic-resin which partly covers the bus-bars and is formed in such a shape as capable of abutting against the outer periphery of the coil assembly; and the housing covers the coil assembly and the bus-bar assembly which is temporarily secured to the coil assembly by abutting the cover against the outer periphery of the coil assembly and by engaging by caulking the caulking portions with the bobbin.

According to the first feature of the present invention, positional misalignment of the bus-bars caused by the pressure of the molten resin during molding of the housing can be prevented by temporarily securing the bus-bar assembly to the coil assembly during molding of the housing and the plurality of bus-bars can be insertion molded under accurate positioning to the housing.

Further, in a preferred embodiment, the cover for the bus-bar assembly has flow control portions formed to inhibit flow of a molten resin from flowing into a gap between the bus-bar assembly and the coil assembly and guide the flow of the molten resin to the outer periphery of the bus-bar assembly during molding of the housing.

In this preferred embodiment, misalignment of the bus-bar assembly can be prevented more reliably by inhibiting the pressure of the molten resin from exerting on the bus-bar assembly in direction of causing the bus-bar assembly to recede from the coil assembly and deformation in the bus-bar assembly by the pressure of molten resin can also be prevented.

Another object can be attained in accordance with the second feature of the present invention by a structure for use in an electromagnetic coil device, comprising a coil assembly, a housing made of a synthetic resin covering the coil assembly, an electric circuit board contained in the housing and bus-bars insertion molded to the housing, and adapted for connecting connection terminals to the circuit board, the connection terminals being formed from a portion of the bus-bars made of a conductive metal insertion molded to the housing made of a synthetic resin and being protruded from the housing, in which terminal bending pedestals adjacent to the respective connection terminals are formed to the housing upon molding of the housing; and the connection terminals bent by pressing the connection terminals against the bending pedestals are connected to the circuit board.

According to this second feature of the present invention, the connection terminals as the portion of the bus-bars insertion molded to the housing can be bent after molding the housing by being pressed against the bending pedestal. Further, since such a jig used for bending can be of a simple shape the connection terminal can be bent easily by using a simple jig.

Further, in a preferred embodiment, a notch is previously formed to each of the connection terminals at a location where the terminal is bent by being pressed against the bending pedestal.

In this preferred embodiment, the connection terminal can be bent more easily.

DESCRIPTION OF THE ACCOMPANYING DRAWINGS

DETAILED DESCRIPTION OF THE PREFERRED EMBODIMENTS

The present invention will be described below in accordance with an embodiment of the invention shown in the accompanying drawings.

Figure 1:
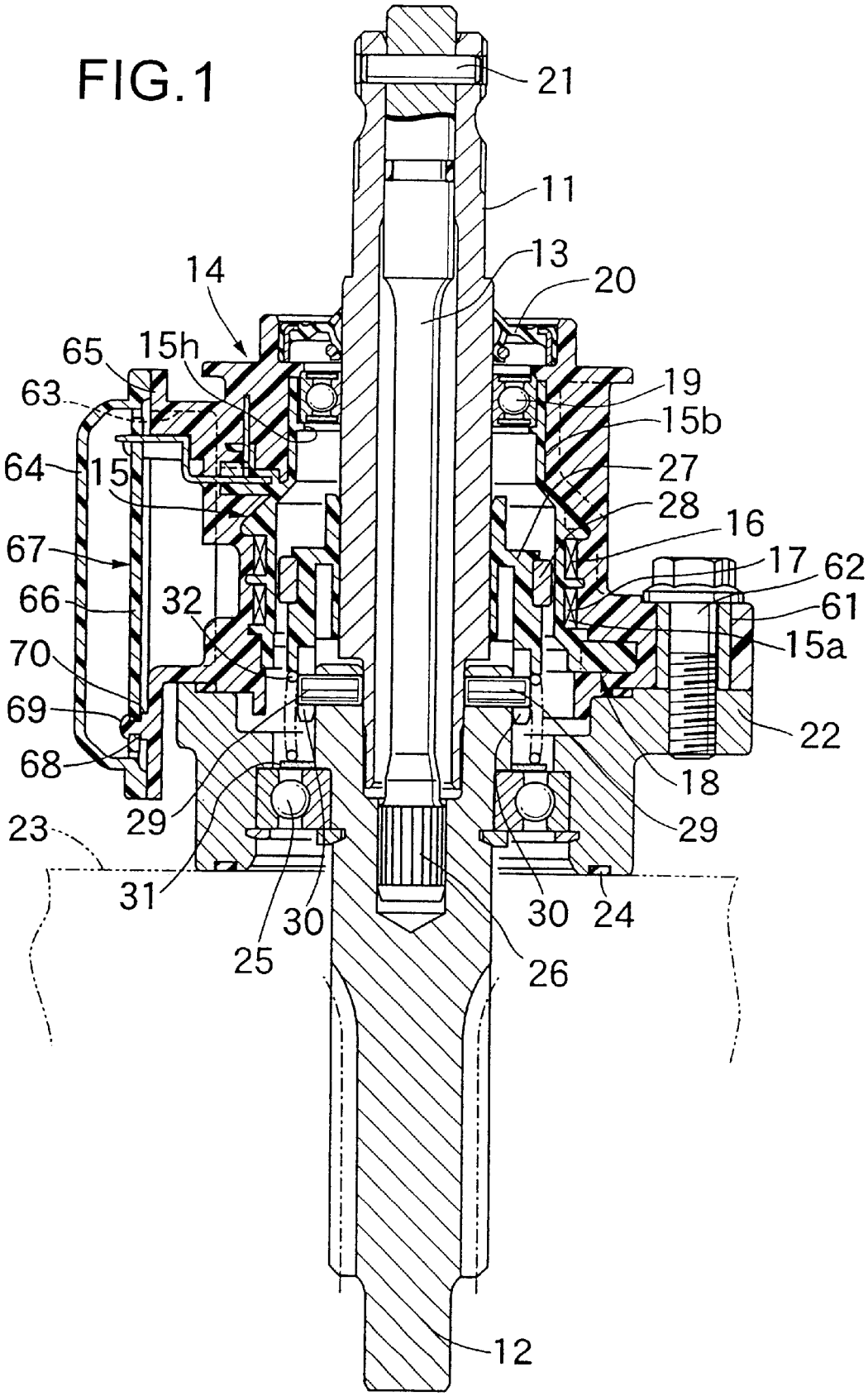
FIG. 1 is a longitudinal cross sectional view of a torque detector to which the present invention is applied.

First, in FIG. 1, a torque detector is incorporated, for example, in a power steering system of a vehicle and comprises an input shaft 11 connected to a not-illustrated steering wheel, an output shaft 12 connected in coaxial with the input shaft 11 to a not-illustrated axle and a torsion bar 13 for connecting the input shaft 11 with the output shaft 12. The torque detector is adapted to detect a relative angular displacement produced between the input shaft 11 and the output shaft 12 due to a twist deformation of the torsion bar 13 corresponding to a torque input to the input shaft 11 as a value in accordance with the input torque.

A housing 14 of the torque detector is made of a synthetic resin and has a cylindrical shape so as to cover a coil assembly 18 comprising a bobbin 15 and first and second coils 16 and 17 wound around the bobbin 15. The input shaft 11 generally of a hollow cylindrical pipe is inserted into the housing 14 while being rotatably supported at one axial end of the housing 14 by way of a ball bearing 19. A dust seal 20 is disposed between the housing 14 and the input shaft 11 at the axial outside of the ball bearing 19.

The torsion bar 13 is inserted in the input shaft 11 and one end of the input shaft 11 and that of the torsion bar 13 are connected each other by a connection pin 21, so that one end of the torsion bar 13 rotates together with the input shaft 11, while the other end of the torsion bar 13 and that of the input shaft 11 can be angularly displaced relative to each other corresponding to a twist deformation of the torsion bar 13.

A metallic support 22 is clamped to the other end of the housing 14, and the support 22 is fixedly supported on a body 23 of a vehicle, and an annular sealing member 24 is interposed between the support 22 and the body 23 for preventing water and dust from intruding into the housing 14 and the support 22.

The output shaft 12 is rotatably supported to the support 22 by way of a ball bearing 25 and the other end of the torsion bar 13 is connected to one end of the output shaft 12 by way of a serration 26.

A movable member 27 made of a synthetic resin is disposed between the bobbin 15 of the coil assembly 18 integrated with the housing 14 and the other end of the input shaft 11, and an annular core 28 is secured to the outside of the movable member 27.

A pair of limit pins 29 and 29 protruding outwardly from the outer periphery of the output shaft 12 along a diametrical line of the output shaft 12 are mounted to one end of the output shaft 12, and limit grooves 30 and 30 for engaging front ends of the limit pins 29 and 29 are formed to the inside of the movable member 27 and extended axially of the output shaft 12. Therefore, the movable member 27 and the core 28 cannot rotate relative to the output shaft 12 but can move axially relative to the output shaft 12 within a range in which the limit pins 29 and 29 are guided in the limit grooves 30 and 30. A coil spring 32 is mounted between the movable member 27 and a retainer 31 seated on the inner ring of the ball bearing 25 disposed between the output shaft 12 and the support 22, so that the movable member 27 and the core 28 are energized by the spring force of the coil spring 32 in a direction receding from the output shaft 12.

Figure 2:
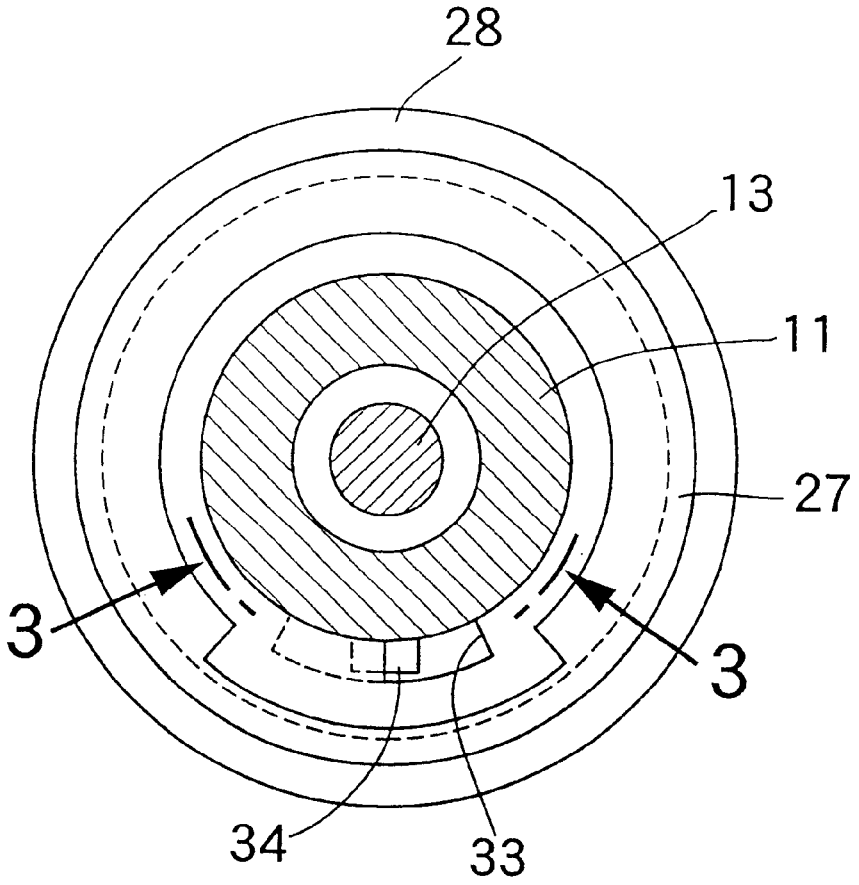
FIG. 2 is a transversal cross sectional view illustrating engagement between an input shaft and a movable member.
Figure 3:
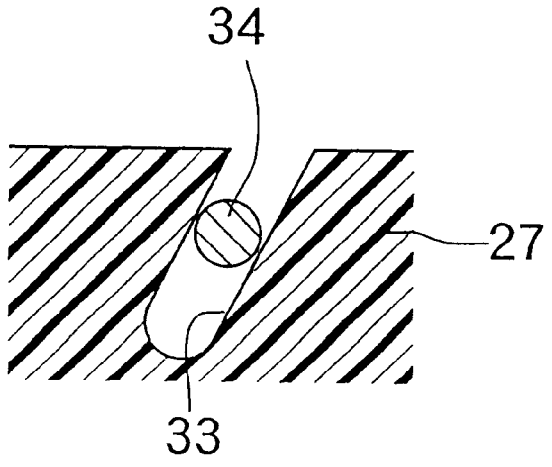
FIG. 3 is a cross sectional view taken along line 3—3 in FIG. 2.

In FIGS. 2 and 3, a spiral guide groove 33 is formed to the inner surface of the movable member 27 and a pin 34 to be fitted to the guide groove 33 is disposed to the input shaft 11. Therefore, when an angular displacement is formed between the input shaft 11 and the output shaft 12 relative to each other due to a twist deformation of the torsion bar 13 in accordance with a torque input to the input shaft 11, the movable member 27 and the core 28 change the position along the axis of the input shaft 11 corresponding to the relative angular displacement.

Figure 4:
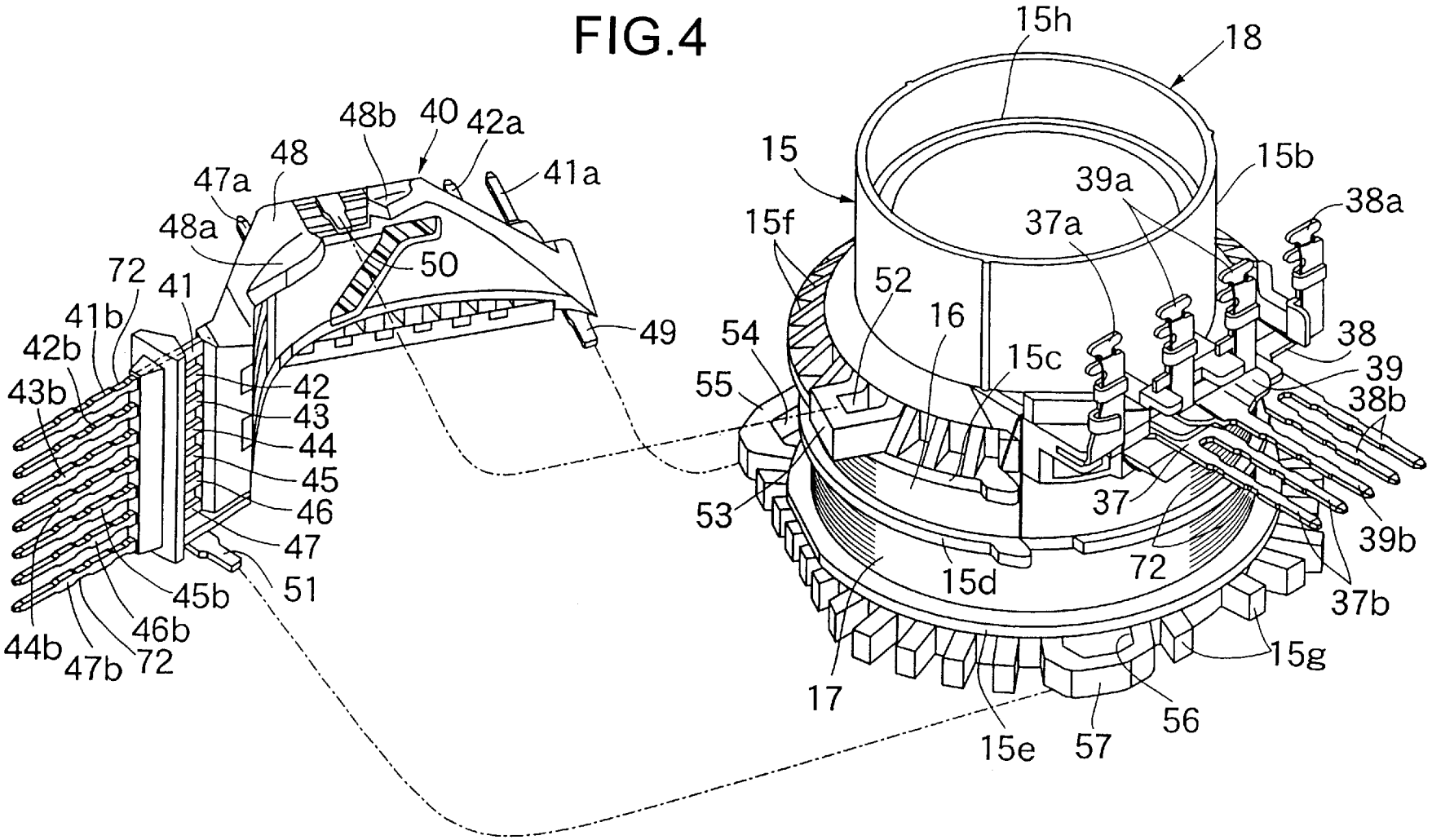
FIG. 4 is an exploded perspective view of a coil assembly and a bus-bar assembly.
Figure 5:
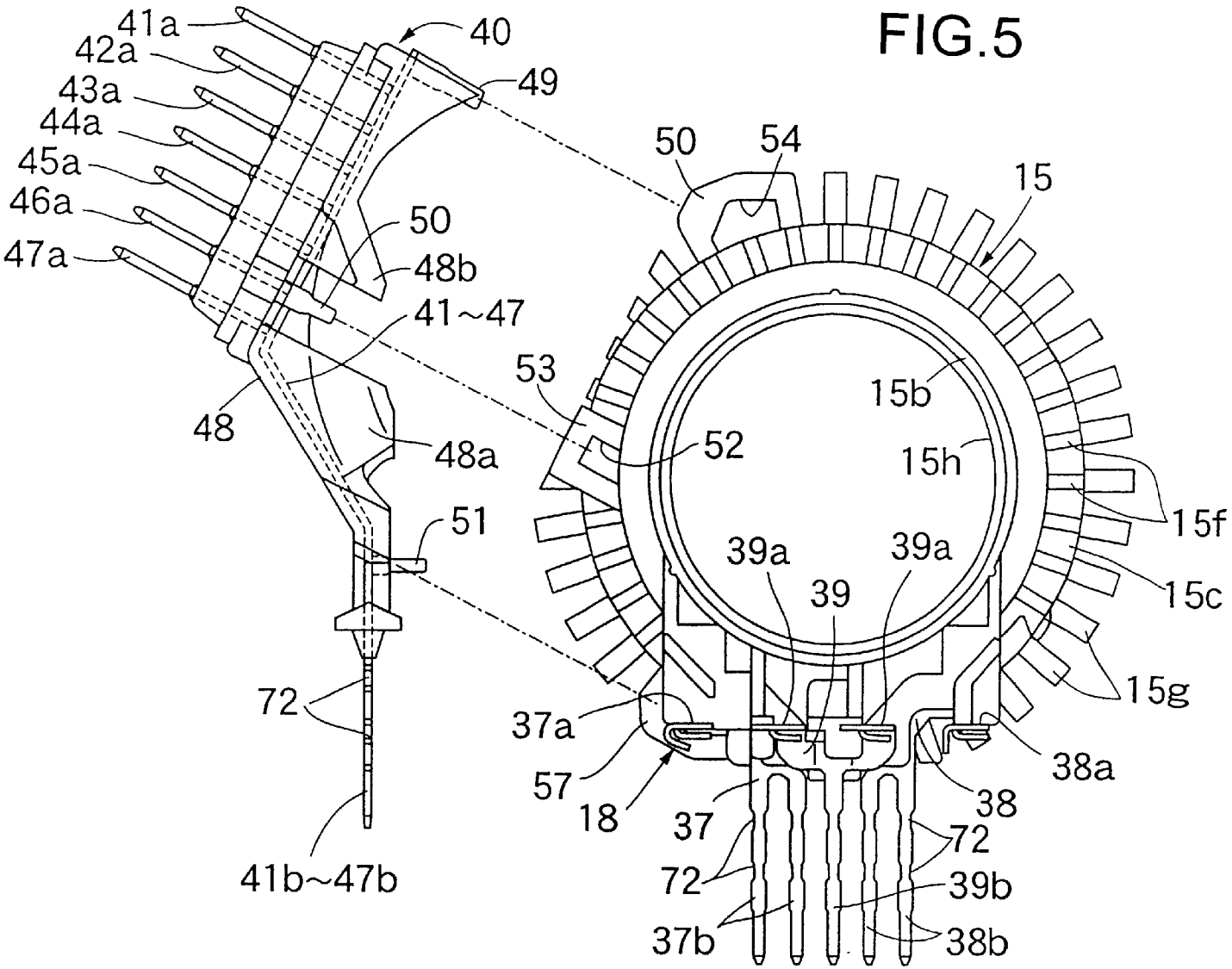
FIG. 5 is an exploded plan view of a coil assembly and a bus-bar assembly.

Referring to FIGS. 4 and 5 together, the bobbin 15 has a generally cylindrical coil winding portion 15*a* and a generally cylindrical extended cylinder portion 15*b* coaxially contiguous with one end of the coil winding portion 15*a*, and the bobbin is formed into a generally cylindrical stepped shape as a whole. Definition walls 15*c*, 15*d* and 15*e* are integrally protruded radially and outwardly on the outer periphery at one end, a middle portion and the other end of the coil winding portion 15*a* for defining a winding range for each of the first and the second coils 16 and 17 wound on the outer surface of the coil winding portion 15*a*.

A plurality of protrusions 15*a*, 15*f*, . . . are radially protruded on the outer periphery at one end of the coil winding portion 15*a* such that the outer ends are in flush with the outer end of the definition wall 15*c* for reinforcing the connection between the bobbin 15 and the housing 14. A plurality of protrusions 15*g*, 15*g*, . . . are radially protruded on the outer periphery at the other end of the coil winding portion 15*a* so as to protrude beyond the definition wall 15*e* for reinforcing the connection between the bobbin 15 and the housing 14.

The ball bearing 19 disposed between the input shaft 11 and the housing 14 is fitted to the front end of the extended cylinder portion 15*b* of the bobbin 15 so as to slightly protrude at the axial outer end of the bearing 19 from the front end of the extended cylinder portion 15*b* and a flange 15*h* for receiving the inner end of the outer ring of the ball bearing 19 is integrally formed on the extended cylinder portion 15*b* so as to radially protrude inwardly from the inner periphery of the extended cylinder portion 15*b*.

The coil assembly 18 comprises the bobbin 15, the first and the second coils 16 and 17 to be wound around the bobbin 15, and three bus-bars 37, 38, and 39 made of a conductive metal to be set to the outer periphery at one end of the coil winding portion 15*a* of the bobbin 15.

Coil connection terminals 37*a* and 38*a* extending outward of the portion 15*b* to one end of the extended cylinder portion 15*b* of the bobbin 15 are formed at respective one ends of the bus-bars 37 and 38 and pairs of forked circuit connection terminals 37*b*, 37*b* and 38*b*, 38*b* are formed respectively at the other ends of the bus-bars 37 and 38 of the coil winding portion 15*a* so as to protrude outwardly from the outer periphery at one end of the coil winding portion 15*a* along the radial direction of the bobbin 15. The bus-bar 39 is set to the bobbin 15 between the bus-bars 37 and 38. A pair of forked coil connection terminals 39*a* and 39*a* are formed outward of the extended cylinder portion 15*b* at one end of the bus-bar 39 so as to extend to one end of the extended cylinder portion 15*b* and a circuit connection terminal 39*b* protruding outwardly from the outer periphery at one end of the coil winding portion 15*a* along the radial direction of the bobbin 15 is formed on the other end of the bus-bar 39.

In a state where the bus-bars 37 to 39 are set to the bobbin 15, the first and the second coils 16 and 17 are connected at respective one ends with the coil connection terminals 37*a* and 38*a* of the bus-bars 37 and 38, for example, by fusing while the first and second coils 16 and 17 are connected at respective the other ends with the coil connection terminals 39*a* and 39*a* of the bus-bar 39, for example, by fusing.

Figure 6:
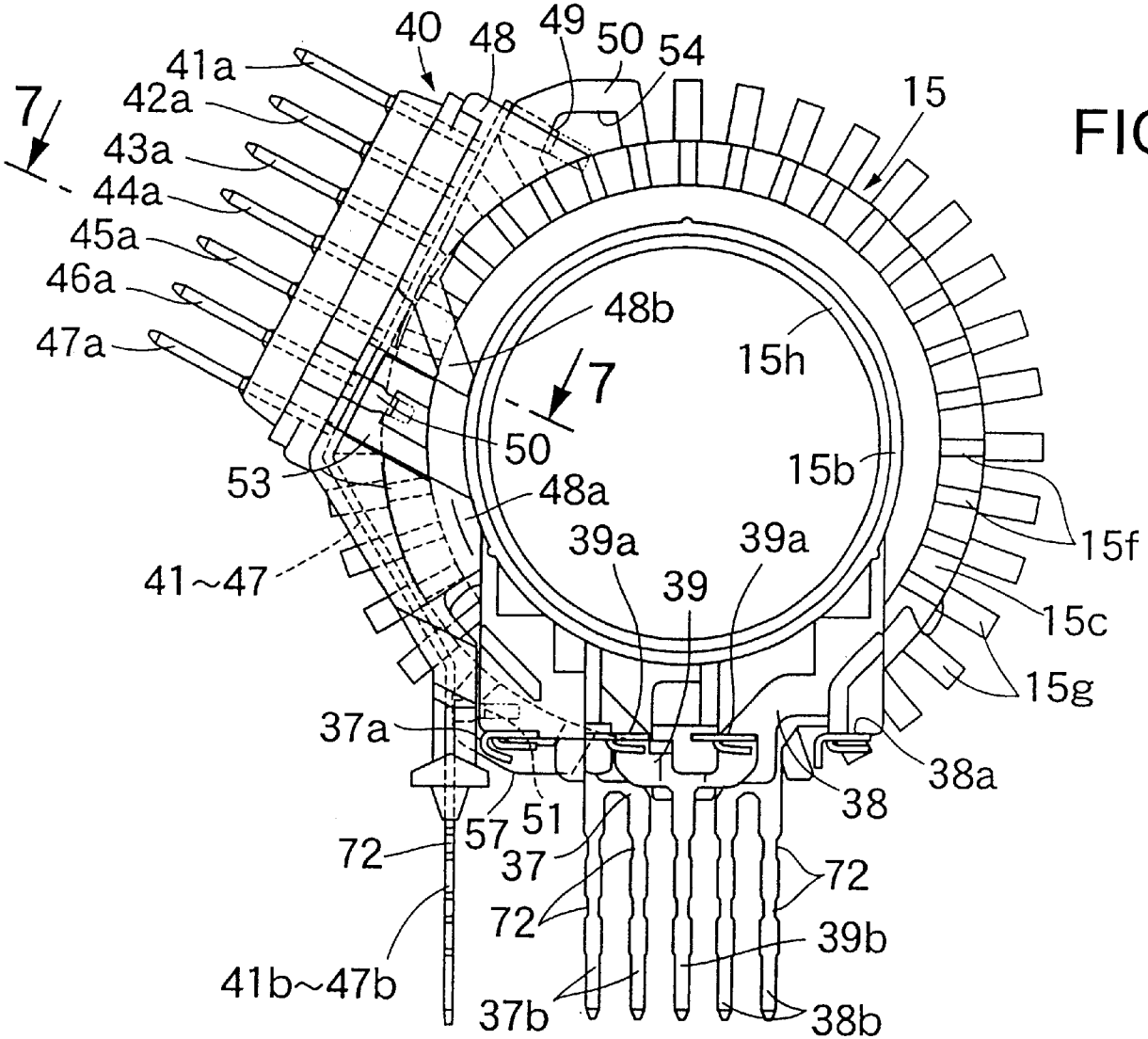
FIG. 6 is a plan view of a coil assembly and a bus-bar assembly temporarily secured to each other.

When the housing 14 is molded, the coil assembly 18, the ball bearing 19 to be fitted to the bobbin 15 of the coil assembly 18 and a bus-bar assembly 40 temporarily secured to the coil assembly 18 as shown in FIG. 6 are inserted into the molding die and the bus-bar assembly 40 is also covered with the housing 14.

The bus-bar assembly 40 comprises a plurality of bus-bars, for example, seven bus-bars 41 to 47 made of a conductive metal, and a cover 48 made of a synthetic resin covering a portion of the bus-bars.

External lead connection terminals 41*a* to 47*a* that protrude outwardly from the cover 48 in parallel with the radial direction of the coil assembly 18 are formed at one respective ends of the bus-bars 41 to 47 in a state where the bus-bar assembly 40 is temporarily secured to the coil assembly 18. Coil connection terminals 41*b* to 47*b* that protrude outwardly from the cover 48 in parallel with the radial direction of the coil assembly 18 are formed on the other respective ends of the bus-bars 41 to 47 in a state where the bus-bar assembly 40 is temporarily secured to the coil assembly 18.

The coil connection terminals 37*b*, 37*b*, 38*b*, 38*b*, and 39*b* of the bus-bars 37 to 39 are set to the bobbin 15 so as to be arranged in line within a plane orthogonal to the axis of the bobbin 15, while the coil connection terminals 41*b* to 47*b* are disposed along the axial direction of the bobbin 15 so as to be generally in an L-shape and orthogonal relative to the arrangement of the coil connection terminals 37*b*, 37*b*, 38*b*, 38*b*, and 39*b*. The external lead connection terminals 41*a* to 47*a* are disposed so as to be arranged in line in a plane orthogonal to the axis of the bobbin 15 at a position displaced in the circumferential direction of the bobbin 15 from positions for the coil connection terminals 37*b*, 37*b*, 38*b*, 38, and 39*b* and 41*b* to 47*b*.

The cover 48 is formed generally in an arcuate shape such that the inner periphery of the cover 48 can be in contact with the outer periphery of the definition walls 15*c* to 15*e*. Caulking portions 49 and 50 which can be engaged by caulking to the bobbin 15 of the coil assembly 18 are integrally formed on the bus-bar 41 among the bus-bars 41 to 47 in a state where the cover 48 is in contact with the definition walls 15*c* to 15*e*. A caulking portion 51 which can be engaged by caulking to the bobbin 15 of the coil assembly 18 is integrally formed on the bus-bar 47 among the bus-bars 41 to 47.

On the other hand, an engagement 53 is integrally protruded on the outer periphery at one end of the coil winding portion 15*a* of the bobbin 15 of the coil assembly 18 and the engagement 53 defines therein a caulking hole 52 for engaging by caulking the caulking portion 50 in relation with the outer periphery at one end of the coil winding portion 15*a*. Engagements 55 and 57 are integrally protruded on the outer periphery at the other end of the coil winding portion 15*a* of the bobbin 15 of the coil assembly 18 and the engagements 55 and 57 define engaging holes 54 and 56, respectively, for engaging by caulking the caulking portions 49 and 51.

Accordingly, the bus-bar assembly 40 is temporarily secured to the coil assembly 18 as shown in FIG. 6 by caulking the caulking portions 49 to 51 to the engagements 53, 55 and 57 of the bobbin 15 in a state where the inner periphery of the cover 48 is in contact with the outer periphery of the definition walls 15*c* and 15*e*.

Figure 7:
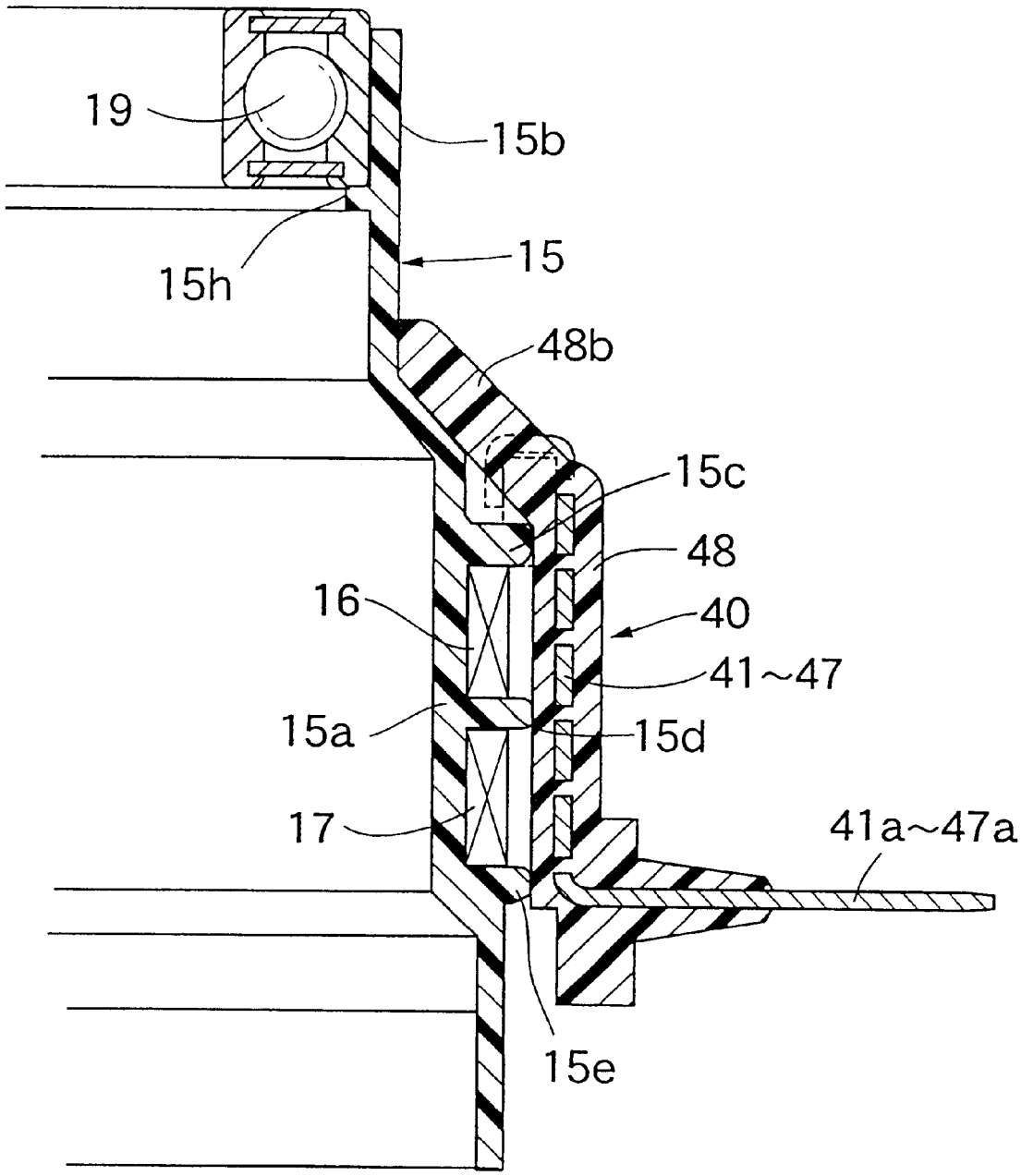
FIG. 7 is a cross sectional view taken along line 7—7 in FIG. 6.

Then, also referring to FIG. 7 together, flow control portions 48*a* and 48*b* are integrally formed to the cover 48 of the bus-bar assembly 40, with front ends of the flow control portions being in contact with the outer periphery of the extended cylinder portion 15*b* of the bobbin 15 on both sides of the caulking portion 50 and with base ends of the flow control portions being in contiguous with the outer periphery of the cover 48. The flow control portions 48*a* and 48*b* have a function of inhibiting a molten resin in a molding die from entering the gap between the bus-bar assembly 40 and the coil assembly 18 and guiding the flow of the molten resin to the outer periphery of the bus-bar assembly 40 when the housing 14 covering the coil assembly 18 and the bus-bar assembly 40 is molded.

Figure 8:
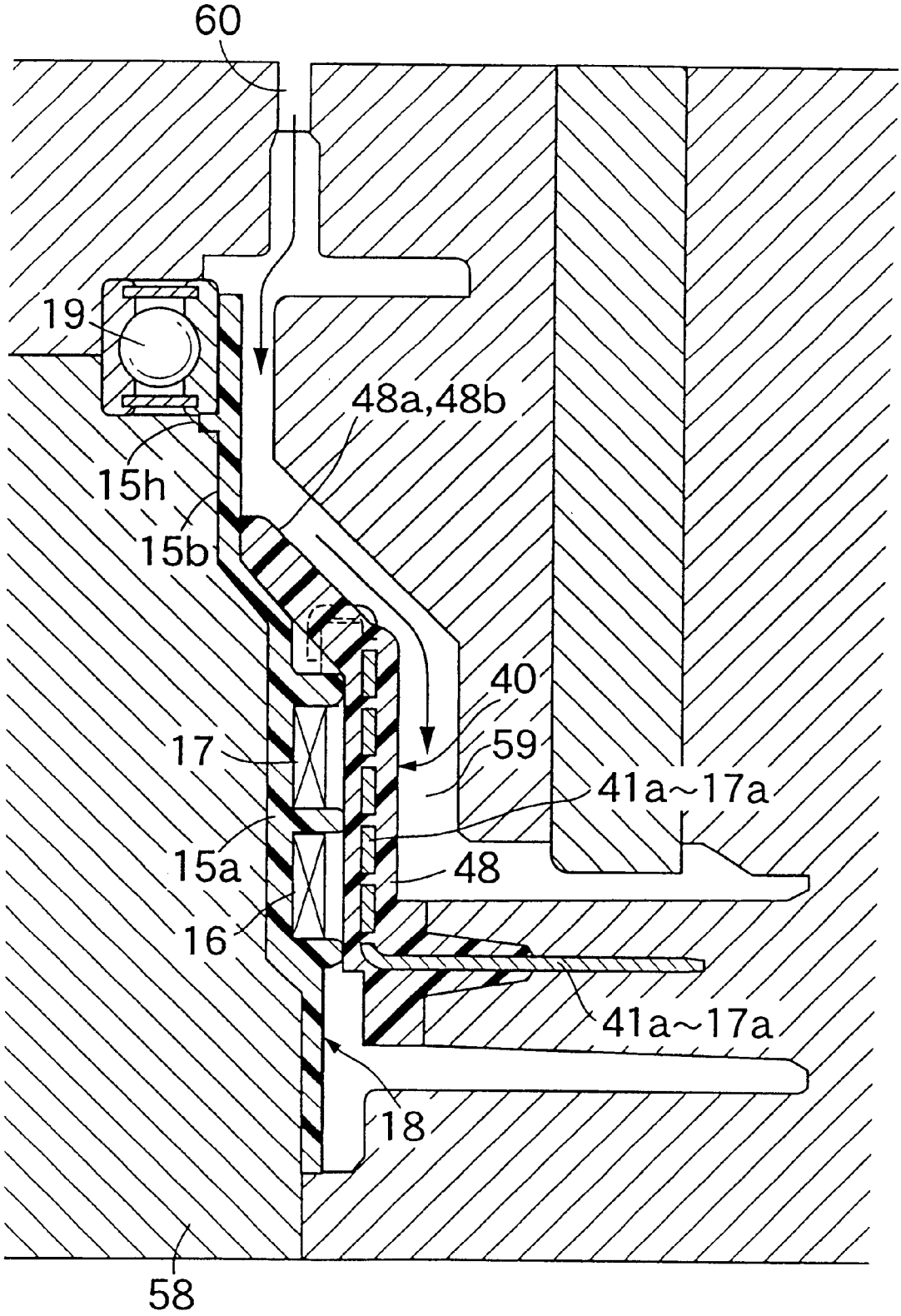
FIG. 8 is a cross sectional view which corresponds to FIG. 7 for illustrating a state of molding a housing.

That is, as shown in FIG. 8, when the coil assembly 18, the ball bearing 19 and the bus-bar assembly 40 are placed in a mold 58 and a molten resin is charged under pressure from a gate 60 on the side at one end of the bobbin 15 into a cavity 59 formed between the coil assembly 18, the ball bearing 19 and the bus-bar assembly 40, and the mold 58 as shown by arrows, the molten resin is guided to the outer periphery of the bus-bar assembly 40 by the flow control portions 48*a* and 48*b*.

Figure 9:
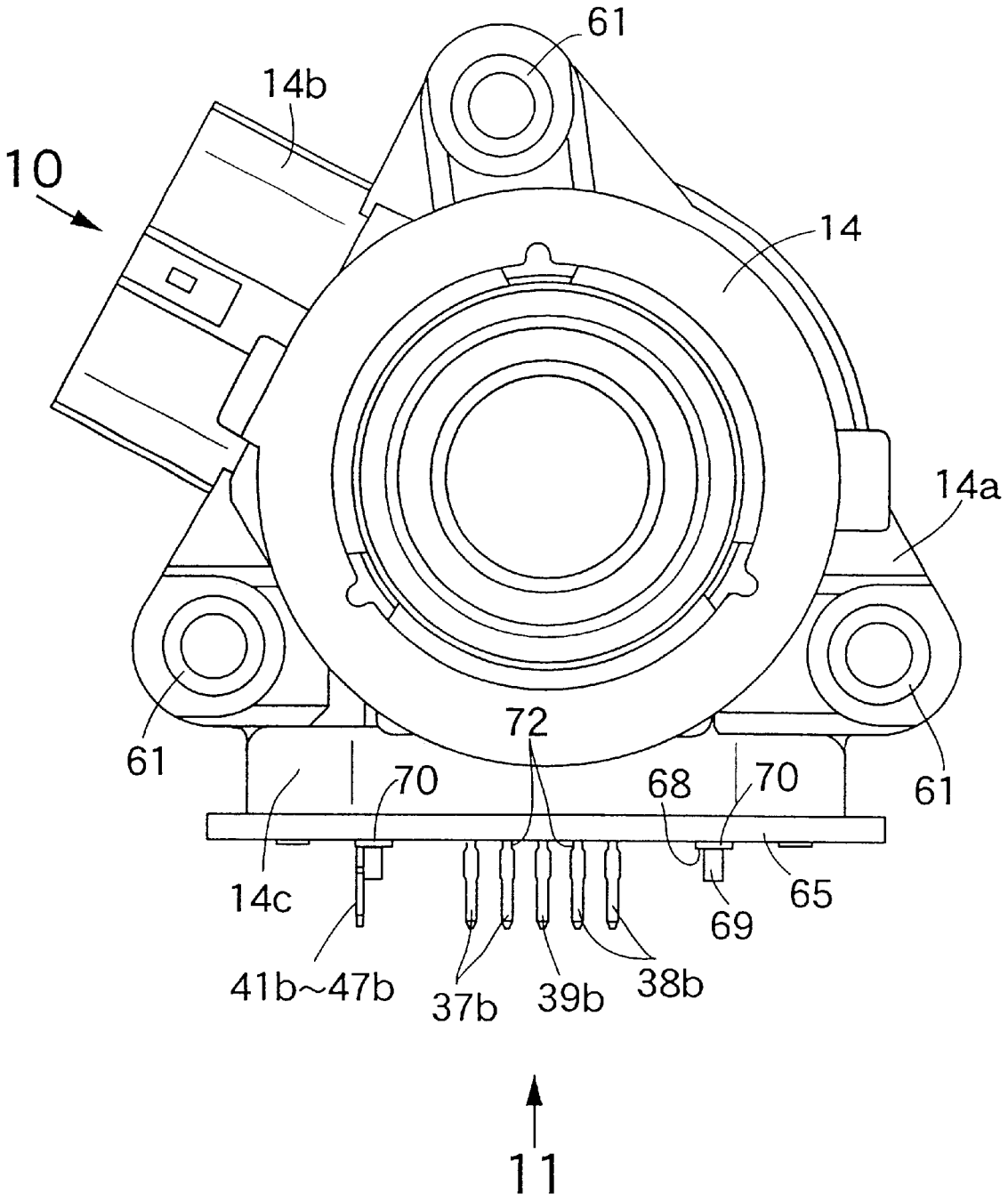
FIG. 9 is a plan view of a housing.
Figure 10:
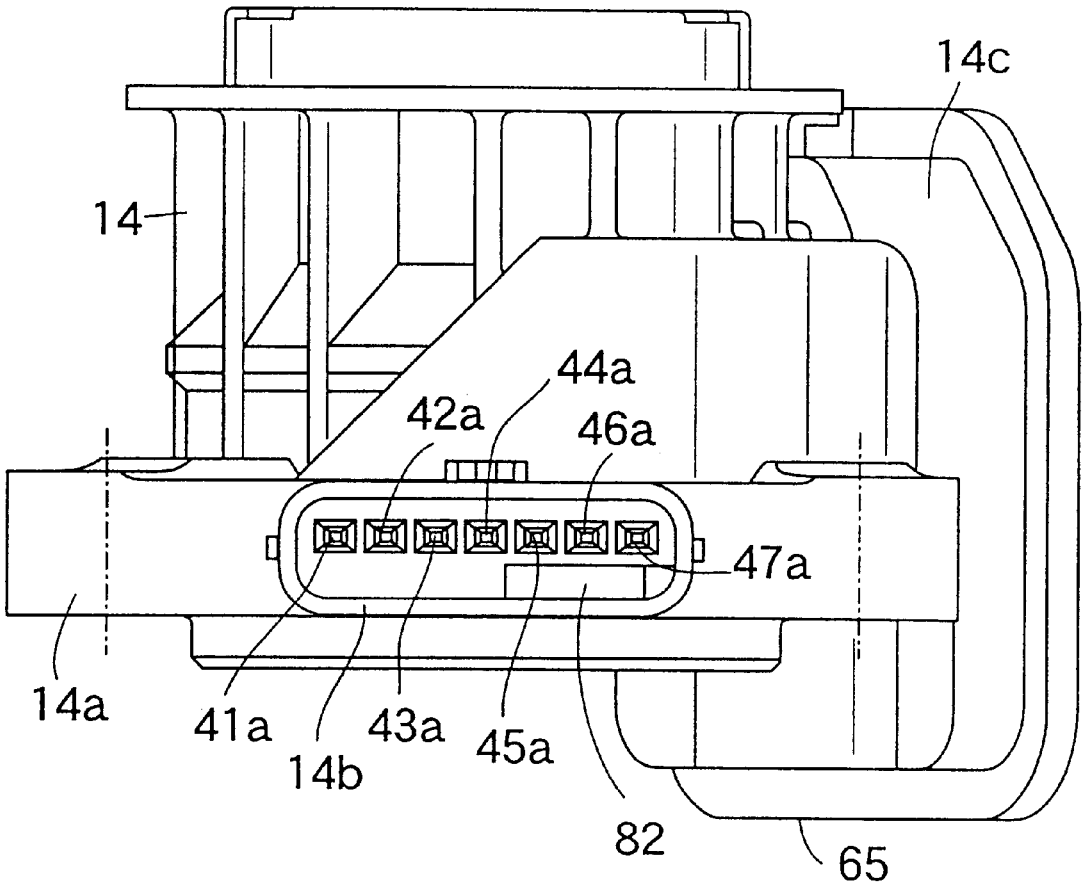
FIG. 10 is a view taken along the direction indicated by an arrow 10 in FIG. 9.
Figure 11:
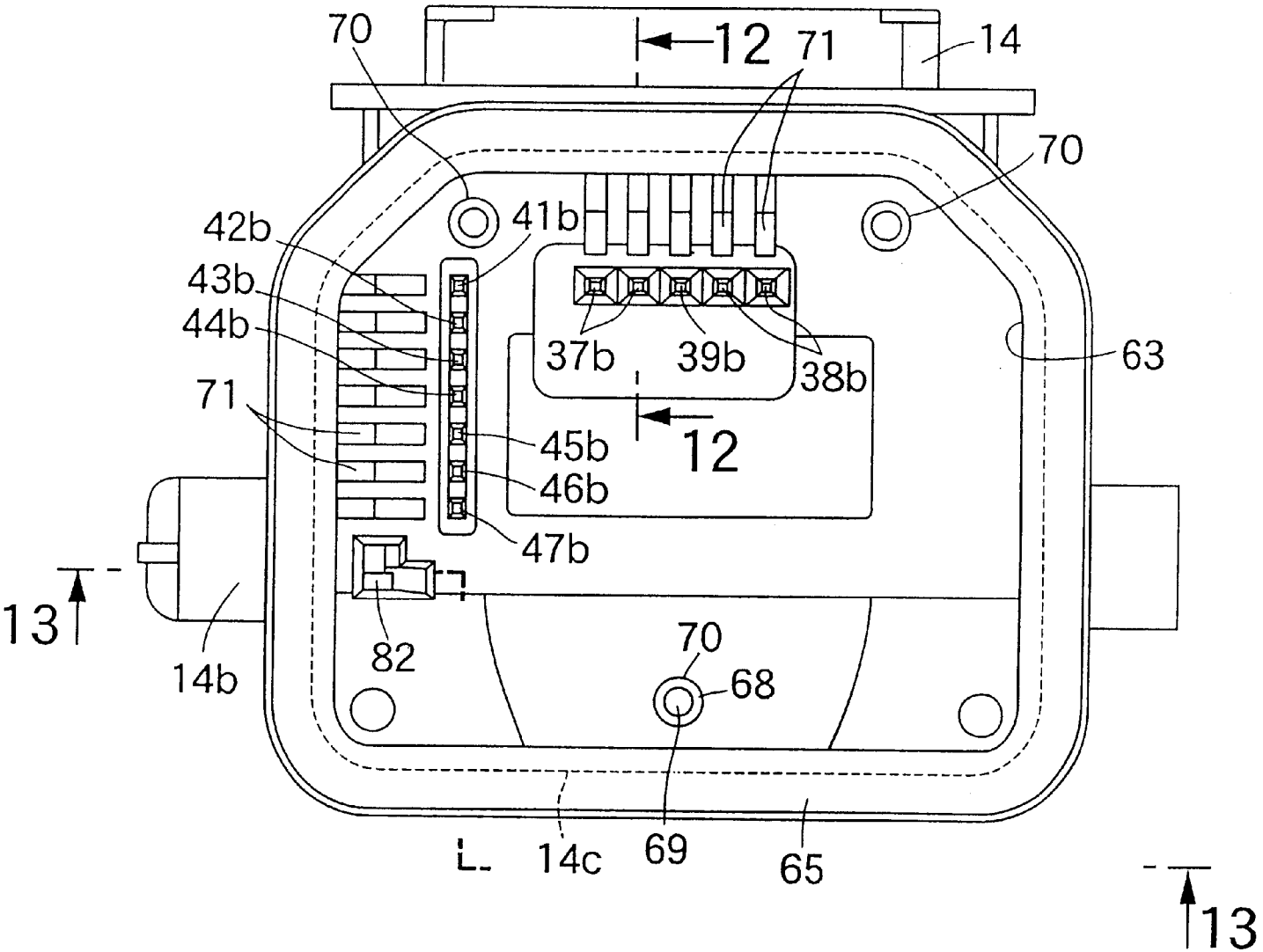
FIG. 11 is a view taken along the direction indicated by an arrow 11 in FIG. 9.

In FIGS. 9 to 11, a flange 14*a* for connecting the housing 14 molded by the mold 58 to the support 22 is integrally disposed to the housing 14 so as to protrude outwardly at three locations equally spaced in the circumferential direction of the housing 14, and cylindrical metallic sleeves 61 are insert-molded to the flange 14*a* at the three locations. A bolt 62 to be screwed to the support 22 is inserted through each of the sleeves (refer to FIG. 1).

A male coupler 14*b* formed into a cylindrical shape having a rectangular transversal cross section and protruded outwardly is integrally formed on the housing 14, and the external lead connection terminals 41*a* to 47*a* at respective one ends of the bus-bars 41 to 47 to be insert-molded to the housing 14 when the bus-bar assembly 40 is covered with the housing 14 are arranged so as to exist in the inside of the coupler 14*b*.

A cylindrical portion 14*c* having a generally rectangular transversal cross section is integrally formed on the housing 14 so as to protrude radially outward of the housing 14, and a containment concave 63 is disposed to the housing 14 so as to define the inside of the cylindrical portion 14*c*. A flange 65 is integrally formed on the outer end of the cylindrical portion 14*c*, and a cover 64 made of a synthetic resin (refer to FIG. 1) is welded to the flange 65 for closing the containment concave 63.

As shown in FIG. 1, an electric circuit 67 comprises a circuit board 55 and electric parts including amplifiers and the like mounted on the board and is contained in the containment concave 63, and the circuit board 66 is attached to the housing 14. The electric circuit 67 is adapted to obtain signals corresponding to an input torque in accordance with a change of inductance of the first and the second coils 16 and 17. That is, the core 28 changes the position along the axis of the input shaft 11, that is, charges a relative position to the first and the second coils 16 and 17 in accordance with a twist deformation of the torsion bar 13 corresponding to a torque input to the input shaft 11. This change of the relative position causes a magnetic change for the coils 16 and 17, to change the inductance of the coils 16 and 17 and signals corresponding to the input torque are obtained in the electric circuit 67 in accordance with the change of the inductance.

For attaching the circuit board 66 , a plurality of bosses, for example, three bosses 70, 70, 70 each having an annular receiving face 68 for receiving the circuit board 66 and a protrusion 69 that protrudes from the receiving face 68 at the front end are integrally protruded on the bottom of the containment concave 63 of the housing 14. The circuit board 66 is secured to the housing 14 by inserting the protrusions 69, through the board 66 , seating the circuit 66 on the receiving face 68, and engaging by caulking the protrusions 69 protruded through the circuit board 66 .

The circuit connection terminals 41*b* to 47*b* at the other ends of the bus-bars 41 to 47 are insert-molded to the housing 14 when the bus-bar assembly 40 is covered with the housing 14, and the circuit connection terminals 37*b*, 37*b*, 38*b*, 38*b*, and 39*b* formed from a portion of the bus-bars 37 to 39 are insert-molded to the housing 14 when the coil assembly 18 is covered with the housing 14. The circuit connection terminals 37*b*, 37*b*, 38*b*, 38*b*, and 39*b*, and 41*b* to 47*b* are protruded from the housing 14 so as to be arranged in the containment concave 63, and the connection terminals are connected to the circuit board 66 , for example, by soldering in a state where the front ends of the terminals are inserted through the circuit board 66 .

The circuit connection terminals 37*b*, 37*b*, 38*b*, 38*b*, and 39*b*, and 41*b* to 47*b* are bent before the circuit board 66 is secured to the housing 14 in order to prevent connected portions between the circuit connection terminals 37*b*, 37*b*, 38*b*, 38*b*, and 39*b*, and 41*b* to 47*b* and the circuit board 66 from being detached by thermal expansion and shrinkage of the terminals. For this purpose, terminal-bending pedestals 71, 71, . . . corresponding, respectively, to the circuit connection terminals 37*b*, 37*b*, 38*b*, 38*b*, and 39*b*, and 41*b* to 47*b* are formed to the housing 14 in the containment concave 63 during molding of the housing 14.

Figure 12:
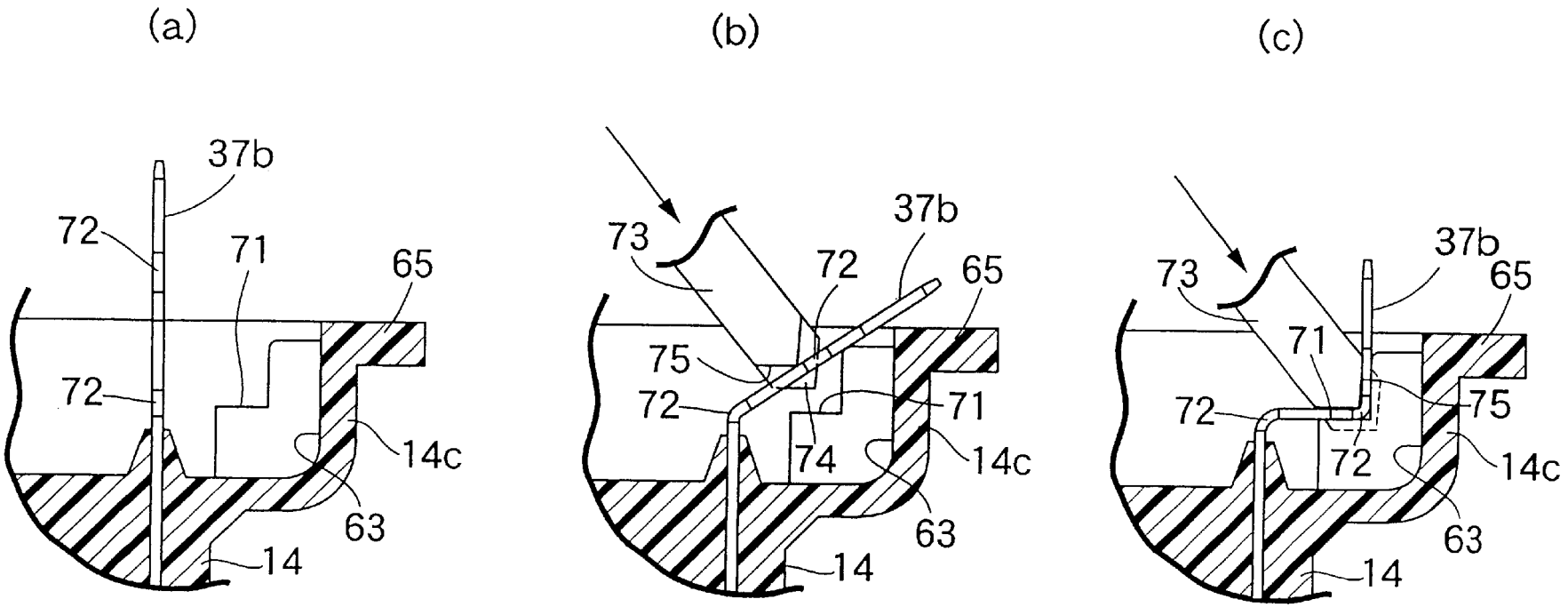
FIG. 12 is a cross sectional view taken along line 12—12 in FIG. 11 illustrating the bending process of a circuit connection terminal.

As shown in FIG. 12, the terminal-bending pedestals 71, 71, . . . are arranged so as to be adjacent with the circuit connection terminals 37*b*, 37*b*, 38*b*, 38*b*, and 39*b*, and 41*b* to 47*b*, respectively, at the outside thereof and each formed into such a shape as capable of bending each of the circuit connection terminals 37*b*, 37*b*, 38*b*, 38*b*, and 39*b*, and 41*b* to 47*b* substantially into an L shaped configuration by pressing each of such terminals.

Further, notches 72 and 72 are previously formed on both sides of each of the circuit connection terminals 37*b*, 37*b*, 38*b*, 38*b*, and 39*b*, and 41*b* to 47*b* at a portion where the terminal is bent by being urged against the terminal-bending pedestals 71.

The circuit connection terminals 37*b*, 37*b*, 38*b*, 38*b*, and 39*b*, and 41*b* to 47*b* are linearly extended and protruded from the housing 14 when molding of the housing 14 is completed as shown in FIG. 12A. A bending jig 73 as shown in FIG. 12(*b*) is used to bend the circuit connection terminals 37*b*, 37*b*, 38*b*, 38*b*, and 39*b*, or 41*b* to 47*b*. The bending jig 73 may be adapted to bend the circuit connection terminals 37*b*, 37*b*, 38*b*, 38*b*, and 39*b*, and 41*b* to 47*b* individually. For improving the bending efficiency, however, it is preferred to use a bending jig capable of bending the circuit connection terminals 37*b*, 37*b*, 38*b*, 38*b*, and 39*b* aligned in line, or circuit connection terminals 41*b* to 47*b* aligned in line all at once. Therefore, the bending jig 73 is formed so as to have, at the front end, a plurality of grooves 74 . . . and pressing portions 75 . . . each of a triangular shape so as to form the bottom of the groove 74 corresponding, respectively, to the circuit connection terminals 37*b*, 37*b*, 38*b*, 38*b*, and 39*b*, or 41*b* to 47*b*. Thus, when the pressing portions 75 . . . are pressed against the circuit connection terminals 37*b*, 37*b*, 38*b*, 38*b*, and 39*b*, or 41*b* to 47*b* and urging them against the terminal bending pedestals 71 . . . as shown in FIG. 12(*c*), each of the circuit connection terminals 37*b*, 37*b*, 38*b*, 38*b*, and 39*b*, or 41*b* to 47*b* is bent substantially at a right angle at the portion of the notches 72, 72 . . .

Thus, after the circuit connection terminals 37*b*, 37*b*, 38*b*, 38*b*, and 39*b*, and 41*b* to 47*b* are bent, the circuit board 66 is attached to the housing 14 and then the circuit connection terminals 37*b*, 37*b*, 38*b*, 38*b*, and 39*b*, and 41*b* to 47*b* are connected to the circuit board 66 .

Figure 13:
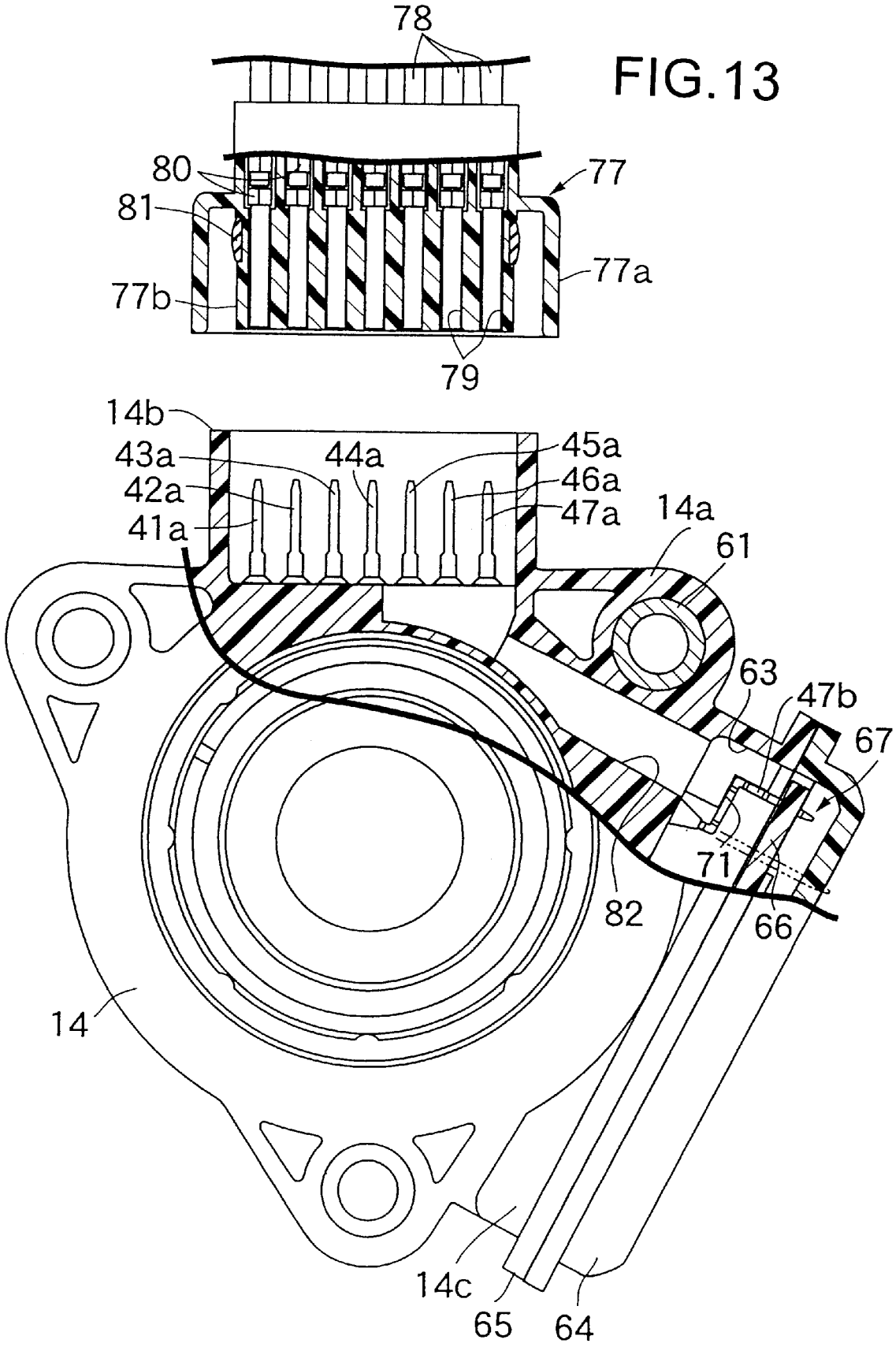
FIG. 13 is a cross sectional view taken along line 13—13 in FIG. 11 for illustrating a state of welding a cover.

In FIG. 13, a female coupler 77 connected to external leads 78, 78, . . . is detachably connected to the coupler 14*b*, being corresponded, respectively, to the external-lead connection terminals 41*a* to 47*a* arranged in the coupler 14*b* disposed to the housing 14. The coupler 77 is made of a synthetic resin and comprises a cylinder portion 77*a* to be fitted to the outer periphery of the coupler 14*b* and an insertion portion 77*b* to be inserted into the coupler 14*b*.

The insertion portion 77*b* has insertion holes 79, 79 . . . for inserting the external lead connection terminals 41*a* to 47*a* respectively, and terminals 80, 80 . . . connected to the external leads 78, 78 . . . , respectively, and detachably fitting the external lead connection terminals 41*a* to 47*a* are secured to inner ends of the insertion holes 79, 79 . . . .

An endless sealing member 81 is disposed to the outer periphery of the insertion portion 77*b* of the coupler 77 in intimate contact with the outer periphery of the coupler 14*b* to keep the liquid sealability of the coupler 14*b* when the coupler 77 is attached to the coupler 14*b* It is necessary to inspect the liquid sealability for the inside of the containment concave 63 which is closed by the cover 64 welded to the flange 65 after the electric circuit 67 is contained in the containment concave 63. In order to inspect the liquid seal, a communication hole 82 that enables to exert an air pressure from the inside of the coupler 14*b* to the containment concave 63 is provided to the housing 14 connecting the inside of the coupler 14*b* with the inside of the containment concave 63.

Advantageous functions of the illustrated embodiment according to the present invention will be described below.

In this embodiment, when the bus-bars 41 to 47 having at respective one ends the external lead connection terminals 41*a* to 47*a* situated in the coupler 14*b* disposed to the housing 14 and having at respective the other ends the circuit connection terminals 41*b* to 47*b* connected to the electric circuit 67 contained in the housing 14 are insert-molded into the housing 14, the bus-bar assembly 40 comprising, as described above, the bus-bars 41 to 47 including the bus-bars 41 and 47 provide with the caulking portions 49, 50 and 51 which can be caulked to the bobbin 15 and the cover 48 for covering a portion of the bus-bars 41 to 47 is temporarily secured to the coil assembly 18 by caulking engaging and the caulking portions 49 to 51 to the bobbin 15 in a state where the cover 48 is in contact with the coil assembly 18.

Accordingly, it is possible to prevent positional misalignment of the bus-bars 41 to 47 caused by the pressure of the molten resin upon molding the housing 14, and the plurality of bus-bars 41 to 47 can be insert-molded under accurate positioning to the housing 14.

Further, since the flow control portions 48*a* and 48*b* for inhibiting the molten resin from entering the gap between the bus-bar assembly 40 and the coil assembly 18 and guiding the flow of the molten resin to the outer periphery of the bus-bar assembly 40 upon molding the housing 14 are formed on the cover 48 of the bus-bar assembly 40, it is possible to prevent the pressure of the molten resin from exerting on the bus-bar assembly 40 in the direction of causing the bus-bar assembly 40 to recede from the coil assembly 18 prevent a positional misalignment of the bus-bar assembly 40 more reliably and it is possible to prevent the bus-bar assembly 40 from being deformed by the pressure of the molten resin.

The circuit connection terminals 37*b*, 37*b*, 38*b*, 38*b*, and 39*b*, and 41*b* to 47*b* constituted with a portion of the bus-bars 37, 38, 39, and 41 to 47 insert-molded to the housing 14 and protruded from the housing 14 are connected to the circuit board 66 attached to the housing 14, for example, by soldering. Then, it is necessary to previously bend the circuit connection terminals 37*b*, 37*b*, 38*b*, 38*b*, and 39*b*, and 41*b* to 47*b* in order to prevent the connected portion of each of the circuit connection terminals 37*b*, 37*b*, 38*b*, 38*b*, and 39*b*, and 41*b* to 47*b* from being detached from the circuit board by thermal expansion and shrinkage of such circuit connection terminals. In this embodiment, since the terminal-bending pedestals 71, 71 . . . adjacent with the circuit connection terminals 37*b*, 37*b*, 38*b*, 38*b*, and 39*b*, and 41*b* to 47*b* are formed to the hosing 14 when the housing 14 is molded, the circuit connection terminals 37*b*, 37*b*, 38*b*, 38*b*, and 39*b*, and 41*b* to 47*b* can be bent only by urging such terminals against the terminal-bending pedestals 71, 71, . . . In addition, since the bending jig 73 for pressing the terminals can be of a simple structure, it is possible to easily bend the circuit connection terminals 37*b*, 37*b*, 38*b*, 38*b*, and 39*b*, and 41*b* to 47*b* by the simple bending jig 73.

Further, since the notches 72 and 72 are previously formed at the portion of each of the circuit connection terminals 37*b*, 37*b*, 38*b*, 38*b*, and 39*b*, and 41*b* to 47*b* which are bent by being pressed against the terminal-bending pedestals 71, 71 . . . , such circuit connection terminals can be bent more easily.

Further, after the electric circuit 67 has been contained in the containment concave 63 provided to the housing 14, the containment concave 63 is closed by the cover 64. In order to inspect the liquid seal for the inside of the containment concave 63 in a state closed by the cover 64, the communication hole 82 that enables to exert an air pressure from the inside of the coupler 14*b* to the inside of the containment concave 63 is provided to the housing 14, connecting the inside of the coupler 14*b* with the inside of the coupler 77, and the coupler 77 can be attached to the coupler 14*b* detachably and in a liquid sealing manner. Therefore, it is no more necessary to close the communication hole 82 since the coupler 77 is attached to the coupler 14*b* after inspecting the liquid seal, which can make the use of a member for closing the communication hole 82, more necessary making it possible to reduce the number of parts, and can save the operation for closing the communication hole 82 to reduce the number of operation steps.

The embodiment of the present invention has been described above in details in conjunction with the drawings. However, the present invention is not restricted only to the illustrated embodiment, but can be modified variously within a scope not departing the gist of the present invention.

For example, the present invention has been explained for the embodiment of the electromagnetic coil device applied to the torque detector, but the invention is applicable, generally, to those devices comprising a coil assembly including a bobbin and coils, a housing made of a synthetic resin integrally having a coupler and covering the coil assembly, an electric circuit contained in the housing and a plurality of bus-bars having one ends disposed in the coupler and the other ends connected to the electric circuit insert-molded to the housing, as well as to those devices in which connection terminals formed from a portion of bus-bars made of a conduction metal to be insert molded to a housing made of a synthetic resin and protruded from the housing are connected to the circuit board attached to the housing.

What is claimed is:

1. An electromagnetic coil device, comprising:

a coil assembly including a bobbin and made of a synthetic resin and coils wound around the bobbin;

a housing made of a synthetic resin integrally having a coupler for covering the coil assembly;

an electric circuit including an electric circuit in the housing; and a plurality of bus-bars, each having a respective one end arranged in the coupler and respective other end connected to the electric circuit board, in which a bus-bar assembly comprises the plurality of bus-bars and a cover made of a synthetic-resin which partly covers the bus-bars;

the cover of the bus-bar assembly having an inner peripheral surface that engages and conforms with a cylindrical outer peripheral surface of the coil assembly, the bus-bar assembly including specified bus-bars having caulking portions that engage with engagements formed at corresponding positions on an outer periphery of bobbin, whereby the bus-bar assembly is temporarily secured to the coil assembly before molding by abutting the cover against the outer periphery of the coil assembly.

2. An electromagnetic coil device as defined in claim 1, wherein the cover for the bus-bar assembly has flow control portions formed integrally to the cover of the bus-bar assembly and extended from the outer periphery of the cover to the outer periphery of the bobbin to close a gap between the bus-bar assembly and the coil assembly thereby inhibiting flow of molten resin from flowing through the gap and guiding the flow of the molten resin to the outer periphery of the bus-bar assembly during molding of the housing.

3. An electromagnetic coil device as defined in claim 1, further comprising connection terminals formed from a portion of the bus-bars made of a conductive metal insertion molded to the housing, said connection terminals being protruded from the housing, in which terminal bending pedestals adjacent to respective connection terminals are formed with the housing during molding of the housing; and the connection terminals, which are bent by pressing the connection terminals against the bending pedestals, are connected to the circuit board.

4. An electromagnetic coil device as defined in claim 3, wherein a notch is formed to each of the connection terminals at a location where the terminal is bent by being pressed against the bending pedestal.

* * * * *